United States Patent [19]

Gallagher

[11] 4,308,905

[45] Jan. 5, 1982

[54] COVER FOR AIR CONDITIONER

[76] Inventor: Nancy Gallagher, 1528 Larchmont Ave., Lakewood, Ohio 44107

[21] Appl. No.: 133,608

[22] Filed: Mar. 24, 1980

[51] Int. Cl.[3] ..... A47B 81/00

[52] U.S. Cl. ..... 150/52 R

[58] Field of Search ..... 150/52 R, 11, 52 K; 52/3; 220/320

[56] References Cited

U.S. PATENT DOCUMENTS

| | | | |
|---|---|---|---|
| 2,863,365 | 12/1958 | Piazze | 150/11 X |
| 2,992,668 | 7/1961 | Collard | 150/52 R |
| 4,039,098 | 8/1977 | Stilts | 150/52 R X |

*Primary Examiner*—Donald F. Norton

*Attorney, Agent, or Firm*—J. H. Slough

[57] ABSTRACT

A cover for an air conditioning unit or the like comprising an open box-like rectangular formed weather tight closure adapted to enclose an end of the said unit when installed in a wall opening such as a window, said closure having cooperating side and end wall portions forming a tunnel about the outer periphery thereof, at least one rigid member threaded through said tunnel, having wound ends projecting outwardly thereof, fastening means adapted to adjustably secure said wound ends together to substantially exert uniform tightening effect about the sides of the air conditioning unit to hold the closure snugly upon the outer periphery of the unit and to keep the conditioner closed thus preventing flow of air therethrough into the adjacent room and to protect the unit from the elements, such as rain, snow and wind.

5 Claims, 10 Drawing Figures

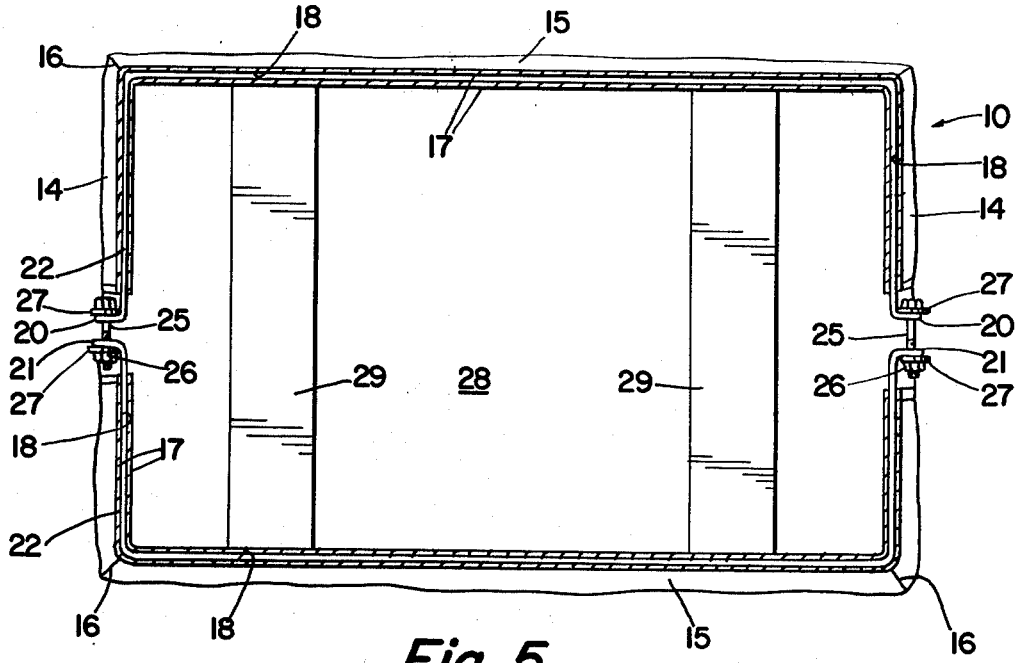
Fig. 5
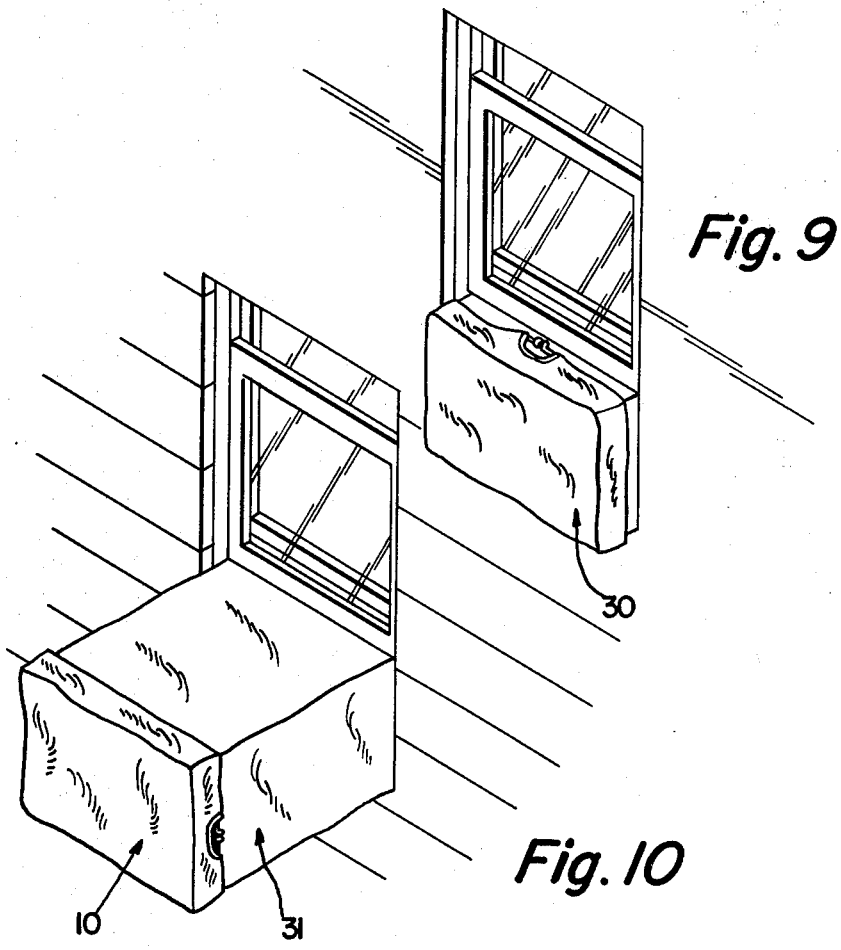
Fig. 9
Fig. 10

COVER FOR AIR CONDITIONER

This invention relates generally to covers for Air Conditioning units and relates more particularly to covers either for the exterior or interior of such air conditioning units or both.

In the past covers have been made for air conditioners particularly adapted for use in protecting the same against inclement weather and against the entrance of the elements and other foreign matter.

Such covers have been normally adjustable through the use of elastic bands such as shown in Singer, U.S. Pat. No. 3,320,996 and others have been provided with side stiffening such as shown in Hoffman U.S. Pat. No. 2,720,236, or ribs such as shown in U.S. Pat. No. 2,992,668. Other proposals have been to mold plastic resin bodies to form containers for air conditioning units as shown in U.S. Pat. No. 3,002,362 to Humphner. It has also been proposed to provide loops and lacings for securing a cover to the air conditioner unit, as shown in U.S. Pat. Nos. 2,771,769 to Katcher et al. There are, of course, many covers and enclosures on the market adapted for use for covering air conditioning units but such covers most commonly require the use of cords or drawstrings, stiffening means or flap means, and said covers generally are adapted to be secured under the window sash. Such constructions have been found to lack security in use and can be easily swept from their seating on their associated air conditioning units by strong winds, gales, storms, etc. and furthermore protect poorly the entrance of air through the air conditioning unit.

It is an object of my invention to provide a cover for an air conditioning unit which has a secure locking engagement with an air conditioning unit and which is adapted to be form-sustaining.

Another object of my invention is to provide a cover having insulating qualities and means to securely prevent air from entering through the air conditioner into the room with which it is associated.

The cover of the present invention is preferably a one-piece open box-like construction adapted to snugly fit over an associated air conditioner and having tightening means disposed about the top, bottom and sides thereof to integrally secure the same on the conditioning casing and form a rigid and secure locking peripheral edge about the air conditioner; the said fastening means is secured thereto and preferably adjustable to accomodate slight variations in sizes of the conditioning units and to obtain an all around uniform locking effort about the contacted surfaces of the air conditioner.

It is an object of this invention further to provide rigidly secure additional covering means for air conditioners of the type projecting outwardly a greater distance than the usual air conditioner used for apartment window mountings, etc.

A further object of the invention is to provide an air conditioner cover which can be adapted for use as an inside air conditioning cover to add further protection against egress of air or wind to the room having the window, etc. in which the air conditioner is seated.

Still other and further objects of the invention itself are to provide a construction simple in manufacture, assembly and possessing energy saving characteristics, the same being durable in use and inexpensive to manufacture.

Other objects of the invention itself become more readily apparent to those skilled in the art by reference to the accompanying description and drawings, in which drawings:

FIG. 5 is a view taken on the line 5—5 of FIG. 3;

FIG. 9 is a perspective view of a second embodiment of my invention;

FIG. 10 is a perspective view similar to FIG. 1 of a third embodiment of my invention.

Figure 1:
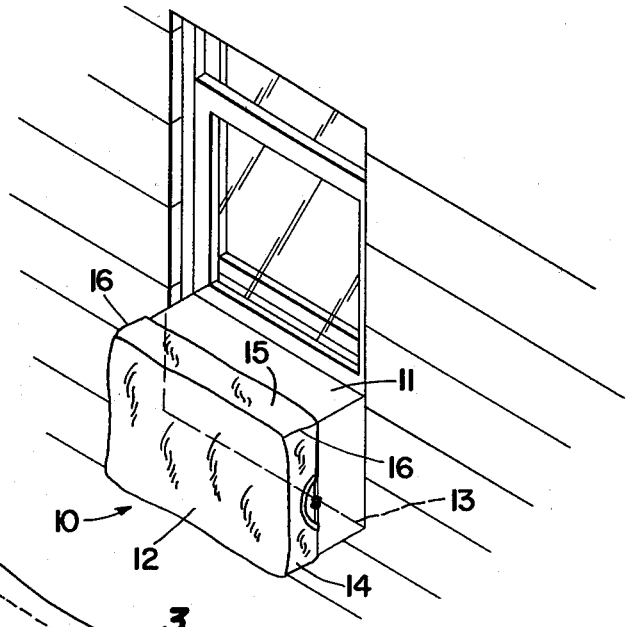
FIG. 1 is a perspective view of an air conditioning unit shown in position on a window and projecting outwardly thereof, the cover of this invention being shown in its applied position thereto.

Referring now more particularly to the drawings, the embodiment of my invention shown in FIGS. 1 to 8 inclusive, comprises a cover 10 as illustrated in FIG. 1 for a cabinet 11, such as the casing of a room air conditioner disposed within the window opening and projecting outwardly therefrom. The casing of the cabinet 11 is commonly disposed within a window or other opening into an inside room and has its underside seated on the window sill or opening ledge 13. Its rear outer end projects outwardly beyond the sill or ledge and its forward end extends to or beyond the sill or ledge into the room which the air conditioner services.

While covers 10 of the present inventions have been primarily developed and employed as housings or casings for window mounted air conditioner units as will be described hereinafter with particular reference thereto, it is to be understood that the device may also be advantageously employed with other and different type cabinets. However, as room air conditioning units are usually permanently mounted in window openings or outer openings in a room as in apartment dwellings, and as it is highly desirable to protect these units from the harsh winter elements, the invention has found its greater application as a cover for such units.

The cover 10 is generally rectangular in its distended configuration and preferably fabricated of water proof and/or flexible sheet material or fabric including canvas, having good weather resistant qualities. The cover 10 includes a generally rectangular rear wall 12, side and end walls 14—14 and 15—15 respectively, said side and end walls being preferably of rectangular shallow depth; the said corners or ends of said end and side walls being secured to (adjacent) corners of adjacent end or side walls at either end thereof as shown at 16. The end walls and side walls may be formed from extensions of the rear wall for example and the corners thereof may be mitered and then stitched or heat sealed, depending on the material of the cover and as the corners are fitted together, the same is formed into an open box form structure. Each end and side wall is provided with coextensive hemming 17 about its outer periphery and affords a tunnel 18 extending longitudinally about the peripheral edge of the cover for the purpose later described.

Figure 6:
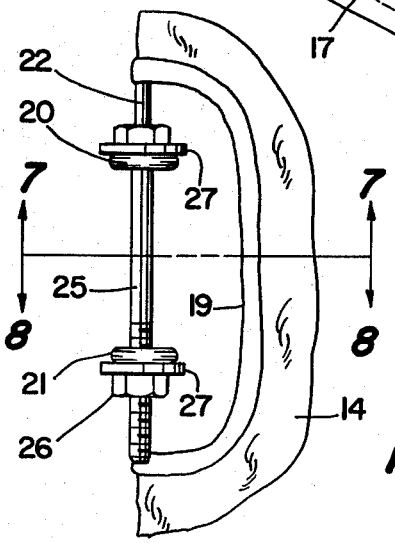
FIG. 6 is an enlarged view of the fastening means of FIGS. 1, 2 and 3.

The side walls in the embodiment of FIGS. 1–8 and 10, it will be noted, are provided with curved notches 19 centrally thereof providing arcuate recesses or openings communicating with spaced open ends of the tunnels of the side walls as best shown in FIG. 6. Oppositely hooked ends 20, 21 of a pair of generally U-shaped wires or rods 22—22, each threaded through one of the upper or lower hemmed portions 17 of the end walls and through a hemmed portion of substantially one-half the upper or lower side wall depending on which of the U-shaped stiffening and/or flexible rods is so threaded. The ends of said rods are thus adapted to project into the said recesses or openings and be secured together 22 at the sides of the cover by a pair of machine bolts 25 or the like provided at either side and projected through hooked ends 20–21 of the opposite facing rods. A nut 26 is then placed on the threaded end of the bolt or other fastening means and tightened to draw the spaced air of U-shaped 22—22 rods together. Washers 27 are preferably placed over the bolt and abut the hooked ends of the several rods when the ends are secured together. The hooked ends 20–21 of the separate rods 22 are preferably hooked in opposite facing directions so that the fastening means are prevented from becoming loosened.

Figure 4:
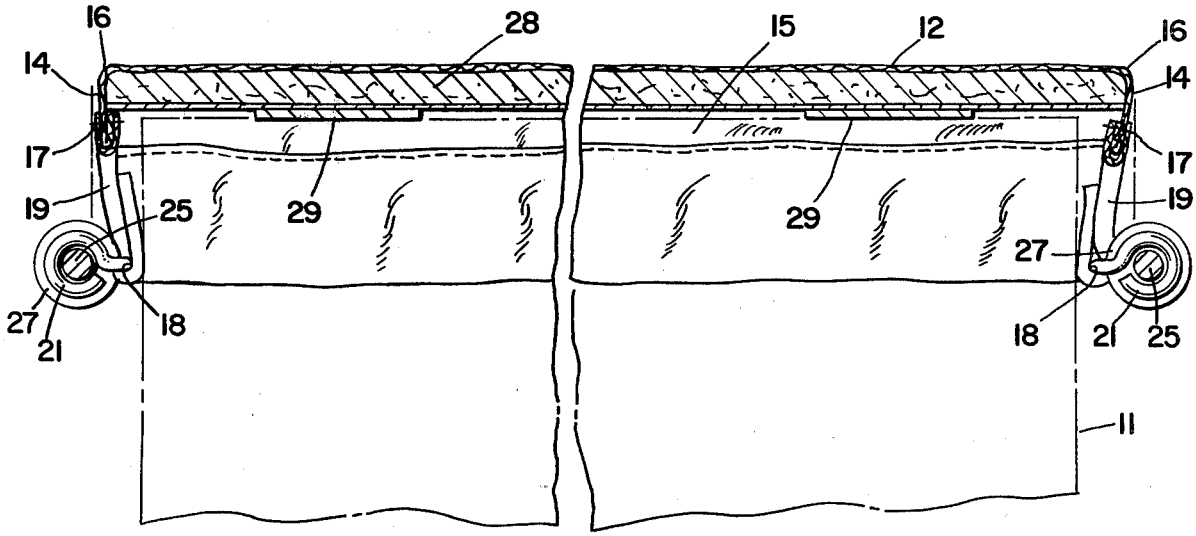
FIG. 4 is a sectional view taken on the line 4—4 of FIG. 2.
Figure 3:
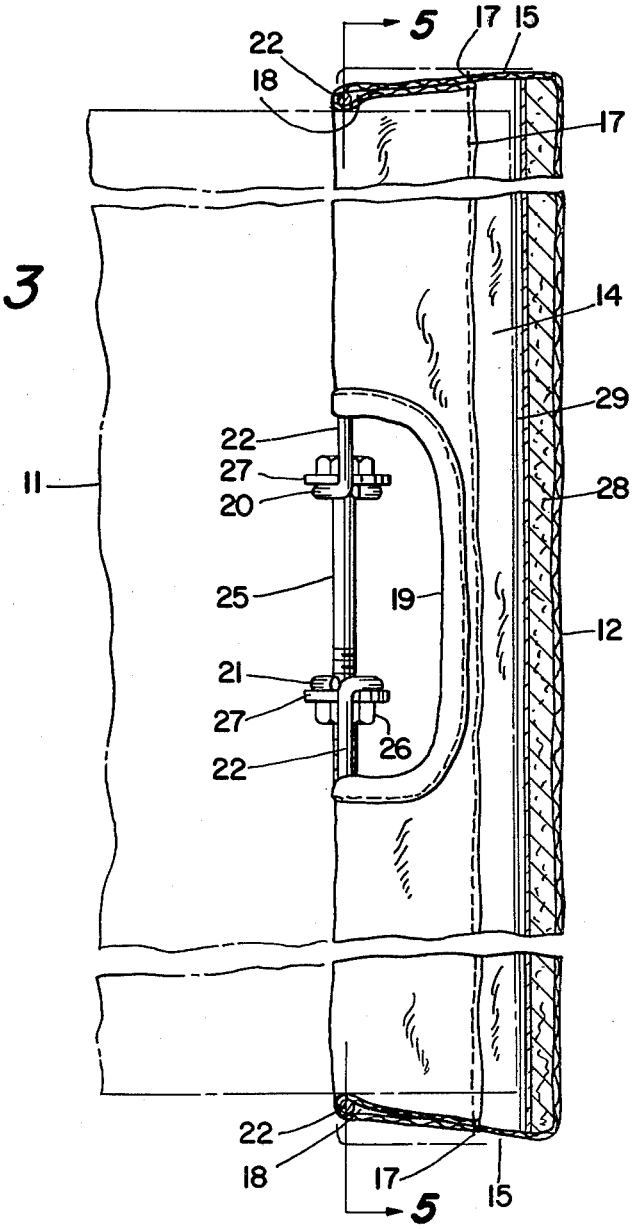
FIG. 3 is a sectional view taken substantially along the line 3—3 of FIG. 2.
Figure 7:
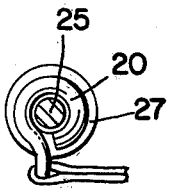
FIG. 7 is a view taken on the line 7—7 of FIG. 6.
Figure 8:
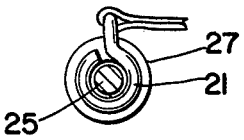
FIG. 8 is a view taken on the line 8—8 of FIG. 6.

In installing the cover over the air conditioning casing, the bolts are tightened at either side by tightening the nuts, separate rods then being drawn closer together and the rods then exert tight and substantially even pressure on all of the sides and ends of the cover wherefor the cover is tightly secured upon the air conditioner, as best shown in FIGS. 3 and 4. As stated, all portions of the ends and side walls of the cover are tightly secured to the casing when the bolts are tightened wherefor a secure lock of the cover on the casing is effected and regardless of strong winds or gales the cover will not be lifted or removed from the casing.

Figure 2:
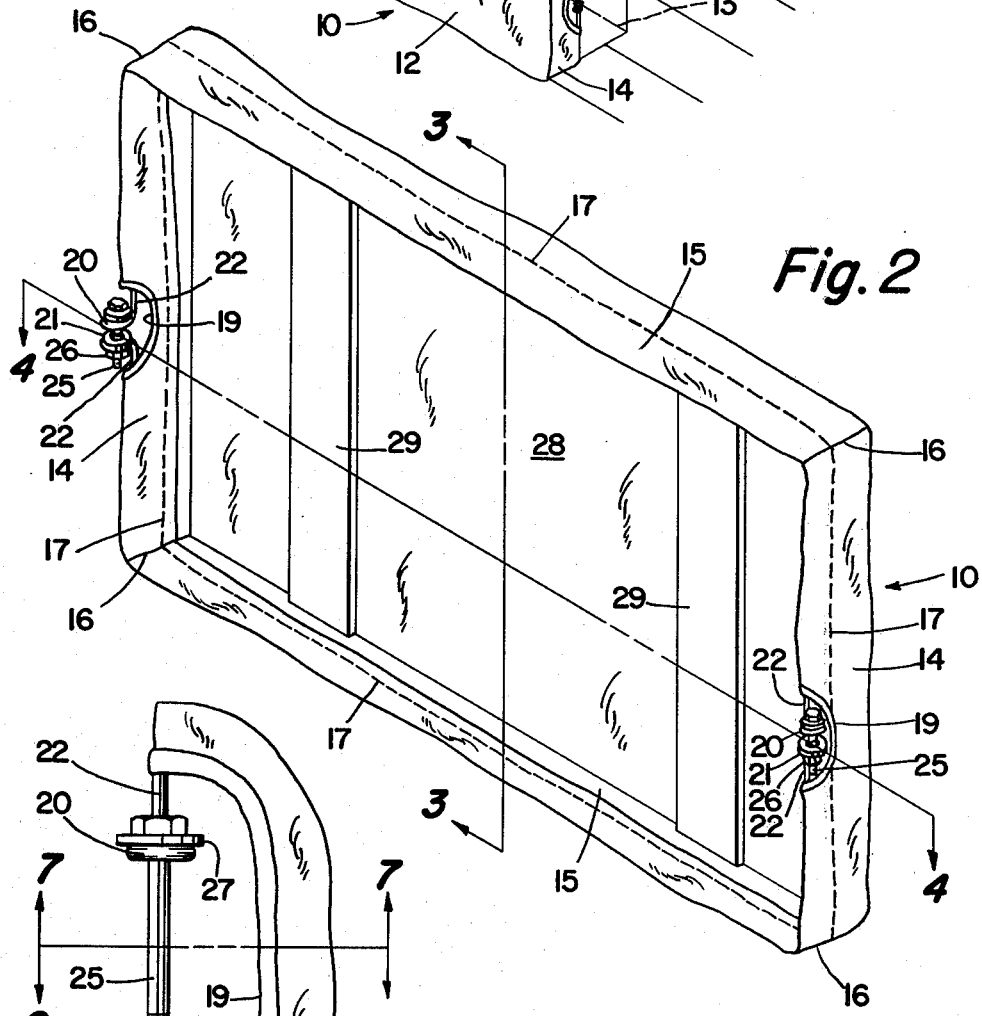
FIG. 2 is a perspective view of the cover viewed from the inside of the unassembled cover.

As best shown in FIGS. 2 and 3, insulating board 28 of the width and length of the rear wall of the cover or insulating batts 28 or the like of similar dimensions are disposed interiorly of the rear of the cover and secured thereto by adhesive or the like. If desired transverse spaced boards 29—29 of the heighth of the rear wall may be used as fastening means to further secure the insulating material to the rear wall.

In the form of my invention shown in FIG. 9 wherein a cover 30, an embodiment of the invention, is disposed on the forward face of the air conditioning unit, it has been found that only one notch need be provided and that it may be placed in the upper end wall of the cover and fastening means securing opposite ends of a single rod together, which rod, as in the first embodiment herein, is disposed in hemming in the peripheral outer edges of the side and end walls thereof. It is contemplated that the inner covers may be made of lighter material and are further not subject to the force of the elements.

In FIG. 10 I have illustrated means for extending the coverage of the cover of my invention by utilizing in the case of air conditioning casings projecting outwardly a considerable distance from the window and a greater depth than the approximate depth of the cover, a tubular sleeve 31 of rectangular form disposed over the casing from adjacent the sill to the cover and secured between the said cover 10 and the casing by tightening the bolts connecting the rods disposed within the hemmed edges of the side and end walls.

While I have described my invention in connection with preferred embodiments thereof, it is to be understood that numerous and extensive departures may be made therefrom, such as changes in fastening means, etc., without however departing from the spirit of the invention or the scope of the appended claims.

I claim:

1. A cover for an air conditioner or the like comprising a bottom wall, a pair of end walls and a pair of side walls, each of said end walls being secured to opposite ends of opposite spaced side walls to form an enclosure for the sides and ends of said conditioner, said cover end and side walls having peripheral hemming disposed therein forming a tunnel substantially around the end and side walls of said cover, at least one member threaded through said tunnel, the said member consisting of a pair of substantially U-shaped rod-like members, each threaded through a tunnel formed by a portion of the spaced side walls and an end wall and each member having a pair of wound ends projecting outwardly into a recess formed in a wall of the cover interrupting the tunnel, fastening means adapted to adjustably tighten the said member to securely lock the cover on the air conditioner.

2. A cover for an air conditioner or the like comprising a bottom wall, a pair of end walls and a pair of side walls, each of said end walls being secured to opposite ends of opposite spaced side walls to form an enclosure for the sides and ends of said conditioner, said cover end and side walls having peripheral hemming disposed therein forming a tunnel substantially around the end and side walls of said cover, at least one member threaded through said tunnel, the said member consisting of a pair of substantially U-shaped rod-like members, each threaded through a tunnel formed by a portion of the spaced side walls and an end wall and each member having a pair of wound ends projecting outwardly into a recess formed in a wall of the cover interrupting the tunnel, wherein said U-shaped members have oppositely wound ends, fastening means adapted to adjustably tighten the said member to securely lock the cover on the air conditioner.

3. A cover for an air conditioner or the like comprising a bottom wall, a pair of end walls and a pair of side walls, each of said end walls being secured to opposite ends of opposite spaced side walls to form an enclosure for the sides and ends of said conditioner, said cover end and side walls having peripheral hemming disposed therein forming a tunnel substantially around the end and side walls of said cover, at least one member threaded through said tunnel, wherein the threaded member is a rigid rod, fastening means adapted to adjustably tighten the said member to securely lock the cover on the air conditioner.

4. A cover according to claim 3, wherein insulating material is disposed covering the inside of the bottom wall of said cover which is adapted to abut the rear wall of said air conditioner.

5. A cover according to claim 3 wherein the tightened member exerts substantially uniform even pressure on the sides and ends of the cover to securely maintain the same on the conditioner.

* * * * *

UNITED STATES PATENT AND TRADEMARK OFFICE

CERTIFICATE OF CORRECTION

PATENT NO. : 4,308,905

DATED : January 5, 1982

INVENTOR(S) : Nancy Gallagher

It is certified that error appears in the above—identified patent and that said Letters Patent is hereby corrected as shown below:

Column 2, line 48, "greater" should read ---greatest---

Column 3, line 18, "air" should read ---pair---

Signed and Sealed this

*Thirteenth* Day of *April 1982*

[SEAL]

*Attest:*

GERALD J. MOSSINGHOFF

*Attesting Officer*

*Commissioner of Patents and Trademarks*